US008702980B2

(12) United States Patent
Mastio et al.

(10) Patent No.: US 8,702,980 B2
(45) Date of Patent: Apr. 22, 2014

(54) APPARATUS FOR CLEANING AN IMMERSED SURFACE HAVING A HYDRAULIC NOSING-UP ACTION

(75) Inventors: Emmanuel Mastio, Fourquevaux (FR); Philippe Blanc-Tailleur, Toulouse (FR); Philippe Pichon, Villeneuve de Riviere (FR)

(73) Assignee: Zodiac Pool Care Europe, Paris (FR)

( * ) Notice: Subject to any disclaimer, the term of this patent is extended or adjusted under 35 U.S.C. 154(b) by 581 days.

(21) Appl. No.: 12/971,253

(22) Filed: Dec. 17, 2010

(65) Prior Publication Data

US 2011/0162683 A1 Jul. 7, 2011

Related U.S. Application Data

(60) Provisional application No. 61/302,191, filed on Feb. 8, 2010.

(30) Foreign Application Priority Data

Dec. 18, 2009 (FR) ..... 09 06139

(51) Int. Cl.
*E04H 4/16* (2006.01)

(52) U.S. Cl.
USPC ..... 210/167.16; 134/166 R; 15/1.7

(58) Field of Classification Search
USPC ..... 210/167.1, 167.16, 167.17; 134/166 R; 15/1.7
See application file for complete search history.

(56) References Cited

U.S. PATENT DOCUMENTS

| | | | | |
|---|---|---|---|---|
| 5,245,723 | A | 9/1993 | Sommer | |
| 6,155,657 | A | 12/2000 | Erlich et al. | |
| 2001/0032809 | A1 * | 10/2001 | Henkin et al. | 210/143 |
| 2003/0201218 | A1 | 10/2003 | Henkin et al. | |
| 2004/0168838 | A1 | 9/2004 | Erlich et al. | |
| 2008/0236628 | A1 | 10/2008 | Horvath et al. | |

FOREIGN PATENT DOCUMENTS

| | | |
|---|---|---|
| EP | 1022411 | 7/2000 |
| EP | 1070850 | 1/2001 |
| FR | 2584442 | 1/1987 |
| FR | 2567552 | 6/2009 |
| FR | 2925552 | 6/2009 |
| FR | 2925558 | 6/2009 |
| WO | WO0250388 | 6/2002 |
| WO | WO2009081944 | 7/2009 |

* cited by examiner

*Primary Examiner* — Fred Prince
(74) *Attorney, Agent, or Firm* — Dean W. Russell; Kilpatrick Townsend & Stockton LLP

(57) ABSTRACT

The invention relates to an apparatus for cleaning a surface which is immersed in a liquid, comprising a hollow body, guiding members defining at least one axle, a filtration chamber, at least one electric motor, a pumping device which creates, in a normal cleaning direction through a filtering device, a liquid flux which is discharged via at least one main outlet, and at least one secondary liquid outlet arranged so as to orientate a current of liquid which is discharged in a backward direction via this secondary outlet so that this current creates a secondary hydraulic reaction force which generates a nosing-up torque of the apparatus by the hollow body being pivoted about the axle.

18 Claims, 4 Drawing Sheets

APPARATUS FOR CLEANING AN IMMERSED SURFACE HAVING A HYDRAULIC NOSING-UP ACTION

Figure 1:
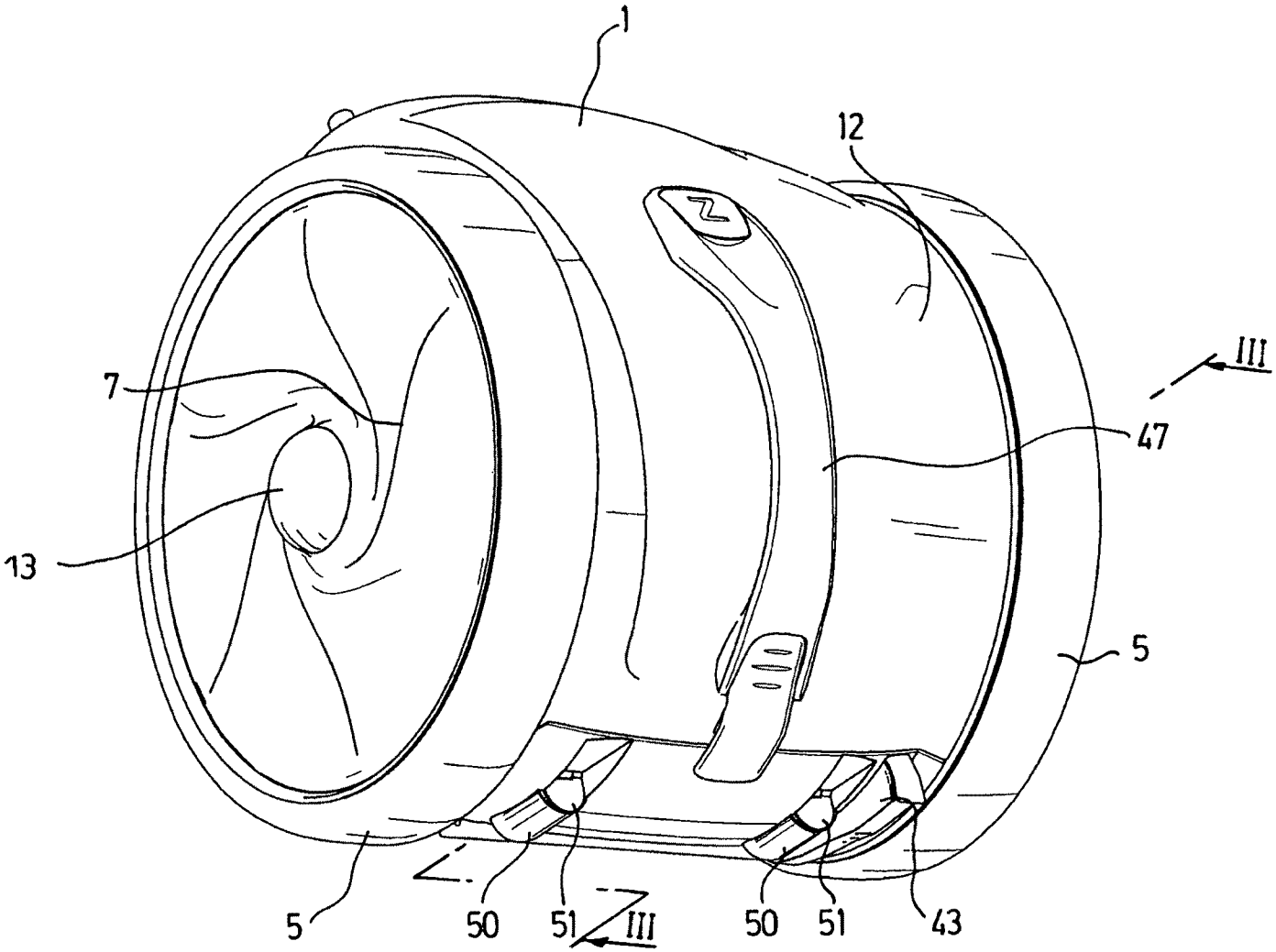

This application claims the benefit of French Patent Application No. 09.06139 filed on Dec. 18, 2009 and claims the benefit of U.S. Provisional Application No. 61/302,191 filed on Feb. 8, 2010, the contents of both of which are incorporated herein by reference.

The invention relates to an apparatus for cleaning a surface which is immersed in a liquid, such as that formed by the walls of a swimming pool, in particular of the self-propelled type with (an) electric motor(s).

There are a great number of apparatus of this type which have been known for some time (cf. typically FR 2 567 552, FR 2 584 442, etc.) and they generally comprise a hollow body; one (or more) electric drive motor(s) which is/are coupled to one or more motorized member(s) for guiding and driving the body over the immersed surface; and an electric pumping motor which drives a pumping member, such as a propeller, which generates a liquid flow between at least one liquid inlet and at least one liquid outlet and through a filtration chamber.

These apparatus are satisfactory but are relatively heavy and costly to produce and use, in particular in terms of electrical consumption.

There have already been proposed apparatus with a single electric motor which serves to simultaneously produce the driving of the apparatus and the pumping of the liquid. However, these apparatus present a problem in terms of cleaning efficiency (speed and/or quality of sweeping the entire surface and/or debris pumping capacity), which assumes in particular that the apparatus can move forwards or backwards along varied trajectories which may be straight or curved, to the left and to the right.

In prior apparatus in which the pumping is ensured by an on-board electric motor, and the driving is also ensured by at least one on-board electric motor, if the apparatus must be bi-directional, that is to say, able to carry out forward and backward trajectories, the possibility of using the electric pumping motor for moving the apparatus is generally excluded, unless a pumping member such as a "vortex" pump or a centrifugal pump is provided (cf. for example U.S. Pat. No. 5,245,723), or a pump with articulated blades (cf. for example EP 1 070 850), which is capable of providing a flow of liquid in the same direction regardless of the rotation direction thereof, but whose pumping performance levels are mediocre. Furthermore, in this last case, the trajectories of the apparatus are limited to two predetermined trajectories, one forwards and the other backwards, that is to say, in practice trajectories which are straight or gyrate at only one side. There is consequently a poor sweeping coverage of the immersed surface which either is not completely cleaned or is completely cleaned only at the end of an excessively long period of time.

In another category of apparatus, there is provision for the driving and/or orientation of the apparatus to be at least partially carried out by the hydraulic reaction brought about by the flux generated by the pumping action. In this manner, for example, EP 1 022 411 (or US 2004/0168838) describes an apparatus which is capable of being partially driven by the hydraulic flux created and has two nozzle outlets which have opposing directions and are supplied alternately via a valve which is operated when the pump is stopped. Owing to wheels which are self-pivoting or which have pivoting axles, the forward and backward trajectories are different. However, apparatus of this type are relatively complex, costly and unreliable, in particular with regard to the control of the pivoting of the valve (or more generally for the change in direction of the hydraulic flux) which requires an operating logic unit and at least one on-board actuator and/or a specific mechanism capable of being locked. Furthermore, in this instance too, only two different predetermined trajectories are possible.

US 2008/0236628 further describes an apparatus for cleaning an immersed surface which allows the apparatus to be prevented from becoming blocked on obstacles of the surface and allows the cleaning to be optimized. This apparatus generates cleaning jets below the base of the body of the apparatus in order to agitate and lift the dirt and the debris. A pair of nozzles which supply jets of cleaning water are thus provided at the front and rear ends of the body. The jet of pressurized water supplied by the front nozzle can be used to help to lift the front end of the apparatus in order to allow it to pass at the bottom of a wall over a vertical surface. However, this jet of water at the front end of the apparatus is not capable on its own of bringing about a nosing-up action of the apparatus. Furthermore, this front jet of water does not allow the apparatus to avoid obstacles of the immersed surface and to move along different trajectories over horizontal or vertical walls.

Furthermore, FR 2925558 describes an apparatus in which the longitudinal component of the normal hydraulic reaction force is used to pass the wall base; FR 2925552 also describes an apparatus in which said longitudinal component is used to climb steps.

An object of the invention is therefore generally to provide a cleaning apparatus—particularly of the type having (an) on-board electric motor(s)—which is both more economical in terms of production and use and which has high performance levels comparable with those of known apparatus, in terms of quality and cleaning, and more particularly providing complete and rapid sweeping of the immersed surface and good suction quality for collecting waste with a satisfactory performance level in terms of energy.

An object of the invention is thus to provide an apparatus of this type which is particularly simple, reliable, compact and light but which has significant movement possibilities.

In a specific embodiment, an object of the invention is to provide an apparatus of this type which comprises a single on-board electric motor and which can be driven in a plurality of—in particular at least three—different predetermined trajectories, in particular in a straight line, round a bend at one side and round a bend at the other side.

An object of the invention is also to provide an apparatus of this type whose electric control unit is particularly simple and economical and can be located entirely out of the liquid.

The invention therefore relates to an apparatus for cleaning a surface which is immersed in a liquid, comprising:

- a hollow body,
- guiding members for guiding said hollow body over the immersed surface, comprising at least one axle which is provided with at least one rolling member,
- a filtration chamber provided in said hollow body and having:
  - at least one liquid inlet into the hollow body,
  - at least one liquid outlet out of the hollow body,
- a pumping device which creates a liquid flux in a normal cleaning direction, between at least one liquid inlet at the base of the hollow body and at least one liquid outlet, called a main outlet, through a filtering device,
- the pumping device being arranged so as to be able to produce a flow of liquid which is discharged via at least one liquid outlet, called a secondary outlet, which is configured to orientate a current of liquid which is discharged via this secondary outlet and creates reaction forces generating a pivot torque of the hollow body about the axle, wherein the pumping device is configured so as to be able to produce a flow of liquid, called a nosing-up flow, which flows in a backward direction from each main outlet and which is discharged via at least one secondary outlet which is configured to orientate the liquid current, called a nosing-up current, which is discharged via said secondary outlet so that this nosing-up current creates reaction forces whose resultant, called a secondary hydraulic reaction force, generates a nosing-up torque and produces a nosing-up action of the apparatus by the hollow body being pivoted about the axle.

In an apparatus according to the invention, the nosing-up flow is obtained by means of a flow which flows in a backward direction relative to the normal cleaning direction of the flow of liquid. In order to obtain said nosing-up flow, it is therefore sufficient to reverse the operating direction of the pumping device. Furthermore, the pumping device and each secondary outlet are configured so that the nosing-up current thus formed creates a secondary hydraulic reaction force which can on its own produce a nosing-up action of the apparatus when it is moving freely over a horizontal or inclined wall of the immersed surface (in particular without coming into contact with a vertical wall or a step).

An apparatus according to the invention may thus have different movement positions over the immersed surface (inclination in a plane containing the movement direction and orthogonal with respect to the immersed surface), including at least one nosed-up position by means of pivoting about the axle under the action of the secondary hydraulic reaction force.

Such a change of position by means of hydraulic reaction can be used in a large number of different situations: for example, to overcome an obstacle which is encountered at the bottom of the pool, to modify the distribution of the debris contained in the filtering device (from an initial receiving zone to a storage zone), to generate different movement trajectories, with a gyration effect which is specific to each direction and each movement position, etc.

In an advantageous embodiment, an apparatus according to the invention is more particularly characterized in that the pumping device comprises:

- at least one axial pumping propeller having a unidirectional pitch and creating a flux of liquid generally orientated along the rotation axis thereof, and which is inserted in said hydraulic circuit,
- at least one reversible electric pumping motor which is carried by said hollow body and which comprises a drive shaft which is mechanically connected to each pumping propeller to drive it in rotation,
- and in that at least one pumping propeller is provided so as to generate:
  - in a first rotation direction, a flow of liquid in a normal cleaning direction (that is to say, between at least one liquid inlet at the base of the hollow body and at least one main liquid outlet, through the filtering device),
  - in a second rotation direction, a flow of liquid in a backward direction from each main outlet which is discharged via at least one secondary outlet so as to create a secondary hydraulic reaction force generating a nosing-up torque of the apparatus about the axle. Thus, in this embodiment, the apparatus is placed in a nosed-up position when the pumping propeller is driven in a second direction opposite the first normal cleaning rotation direction.

Furthermore, preferably, advantageously and according to the invention, at least one main outlet is configured to orientate a current of liquid which is discharged via this main outlet in said first rotation direction so that this current creates reaction forces whose resultant, called a main hydraulic reaction force, has a non-zero component for driving the apparatus, called a forward horizontal component, parallel with the rolling plane and orientated in one direction, called a forward direction, of movement of the apparatus on the immersed surface, in which it cleans the immersed surface.

In this manner, an apparatus according to the invention is driven in a normal forward cleaning direction at least partially by means of hydraulic reaction. Preferably, an apparatus according to the invention is moved forwards over the immersed surface only by means of hydraulic reaction, that is to say, by said main hydraulic reaction force.

Furthermore, advantageously and according to the invention, at least one secondary outlet is configured to orientate the current of liquid which is discharged via this secondary outlet in said second rotation direction so that the secondary hydraulic reaction force also has an apparatus drive component which is not zero, called a backward horizontal component, parallel with the rolling plane and orientated in one direction, called a backward direction, of movement of the apparatus on the immersed surface opposite a direction, called a forward direction, of movement of the apparatus on the immersed surface, in which it cleans the immersed surface.

Consequently, said secondary hydraulic reaction force produces not only the nosing-up of the apparatus about the nosing-up axle, but also the movement of the apparatus in a backward direction opposite the normal cleaning direction. Preferably, an apparatus according to the invention is moved backwards over the immersed surface only by means of hydraulic reaction, that is to say, by said secondary hydraulic reaction force. Preferably, an apparatus according to the invention is moved over the immersed surface only by means of hydraulic reaction, said axle not being a drive axle.

Furthermore, an apparatus according to the invention comprises an electric control unit which is configured to control each motor principally in a forward direction (in the normal cleaning direction of the liquid flow) and to control each motor from time to time in a backward direction (in a backward direction of the liquid flow).

Such an electric control unit can advantageously be arranged out of the liquid and be connected via a cable to the immersed apparatus. However, there is nothing to prevent such an electric control unit from being completely or partially provided on-board the apparatus.

Furthermore, advantageously and according to the invention, said electric control unit is configured to control each motor at least in one movement direction of the apparatus over the immersed surface in a speed selected from at least two different speeds corresponding to two different positions of the apparatus, including a nosed-up position by the hollow body being pivoted about the axle. Thus, in this movement direction, in particular preferably in the backward direction, the apparatus can be driven in accordance with two different speeds for which it has two different positions, at least one of them being a nosed-up position, that is to say, a position different from its normal movement position in a normal forward direction for cleaning the immersed surface.

An apparatus according to the invention can therefore be controlled in at least three different trajectories, that is to say, said first and second predetermined trajectories in one movement direction of the apparatus and at least one other trajectory, different from the first and second trajectories, in the other movement direction of the apparatus.

Furthermore, there is nothing to prevent any number of different speeds being provided in each movement direction of the apparatus, corresponding to a number of different positions (selected from a non-nosed-up position and positions which are nosed-up to a greater or lesser extent) of the apparatus, respectively, each position itself corresponding to a predetermined trajectory which is specific per se, that is to say, different from the trajectories brought about by the other movement positions of the apparatus.

However, advantageously and according to the invention, said electric control unit is configured to control each motor in a first movement direction of the apparatus in a single speed, and in a second movement direction of the apparatus in a speed selected from at least two different speeds, including at least a first speed at which the apparatus moves into a first movement position and at least a second speed at which the apparatus moves into a second nosed-up movement position.

In each movement position, the hollow body can be stabilized in terms of its angular position about the axle using any appropriate means, in particular by means of dynamic balance, by at least one stop (which comes into contact with the immersed surface) limiting the pivoting involved in the nosing-up action, etc.

In particular, an apparatus according to the invention advantageously comprises at least one runner which is arranged so as to come into contact with the immersed surface in at least one nosed-up position of the apparatus so as to produce a gyration of the apparatus at one side.

Advantageously, an apparatus according to the invention comprises at least one runner which is laterally offset relative to the nosing-up axle and arranged so as to come into contact with the immersed surface in a nosed-up position in order to produce a gyration of the apparatus at one side.

Such a runner is inactive (remote from the immersed surface) when the hollow body is in its normal operating position (cleaning the immersed surface) and can be adapted to only locally brake the hollow body by means of friction contact with the immersed surface when it is in a predetermined nosed-up position, thereby producing a gyration at one side. In a variant, such a runner can be configured to locally raise the hollow body and disengage at least one member for guiding the nosing-up axle which is located close to the runner. Furthermore, such a runner can be arranged so as to be laterally offset relative to the nosing-up axle (relative to a median direction of the nosing-up axle) in order to produce local braking or disengagement of a guiding member, and therefore a gyration of the apparatus at one side predetermined in this manner, or in contrast to be generally centered in a median direction of the nosing-up axle in order to produce a disengagement of each guiding member, the apparatus being driven in terms of gyration at one side or the other (defined in a random manner) owing to inevitable occurrences of operational imbalance owing, for example, to the traction of the power supply cable.

In one possible variant, an apparatus according to the invention advantageously comprises a first runner arranged so as to come into contact with the immersed surface only in a first nosed-up position and a second runner arranged so as to come into contact with the immersed surface only in a second nosed-up position, and the second runner is laterally offset relative to the nosing-up axle opposite the first runner so that, in said second nosed-up position, the apparatus is driven in terms of gyration at the side opposite that towards which it is driven in terms of gyration in said first nosed-up position. Advantageously and according to the invention, each runner is arranged so as to come into contact with the immersed surface at the rear of the nosing-up axle relative to the movement direction of the apparatus.

In one advantageous embodiment, an apparatus according to the invention is further characterized in that:

- the guiding members comprise at least one non-motorized member for guiding the hollow body relative to the immersed surface, each non-motorized guiding member being offset in the movement direction relative to the nosing-up axle,
- the nosing-up axle is a front axle, each non-motorized guiding member being arranged towards the rear relative to the front nosing-up axle, and in that said electric control unit is configured to control each motor:

- in a first rotation direction corresponding to the forward movement direction of the apparatus over the immersed surface and, regardless of the speed thereof, in a normal non-nosed-up movement position in which all the guiding members are in contact with the immersed surface,
- in a second rotation direction, corresponding to a movement direction, called a backward direction, opposite the forward movement direction of the apparatus over the immersed surface and, in accordance with its speed, in a movement position selected from a first movement position and a second nosed-up movement position in which at least one non-motorized guiding member which is located in front of the nosing-up axle relative to said backward movement direction of the apparatus is disengaged from the immersed surface.

Preferably, in each nosed-up position of the apparatus, at least one non-motorized guiding member located in front of the nosing-up axle relative to the movement direction of the apparatus is disengaged from the immersed surface. Preferably, at said second more rapid speed corresponding to said second nosed-up position, each non-motorized guiding member located in front of the nosing-up axle relative to said movement direction of the apparatus is raised and disengaged from the immersed surface.

Advantageously and according to the invention, said electric control unit is configured to control each motor in the first rotation direction at a predetermined speed and in the second rotation direction at a speed selected from a first slow speed at which the apparatus is in a first movement position and a second rapid speed at which the apparatus is in a second nosed-up movement position.

Furthermore, several variants are possible with regard to the various movement positions of the apparatus. In a first variant in accordance with the invention, said electric control unit is adapted to control each motor in the first rotation direction corresponding to the normal forward cleaning direction at a first speed so that it takes up a first movement position corresponding to a normal non-nosed-up movement position of the apparatus in which each guiding member is in contact with the immersed surface.

In a second variant according to the invention, said electric control unit is configured to control each motor at said first speed so that the said movement position also corresponds to a nosed-up position in which it is at least partially raised relative to the immersed surface by means of pivoting about the nosing-up axle from a non-nosed-up position (normal movement position, in particular for which all the guiding members are in contact with the immersed surface, the rolling plane defined by these members coinciding with the immersed surface), the apparatus being less nosed-up in said first nosed-up position than in said second nosed-up position.

Furthermore, different movement trajectories of the apparatus corresponding to the different positions of the apparatus can be obtained by various means: by means of hydraulic resistances which are different from one position to another and which are asymmetrical in at least one position or in some positions, in order to produce a gyration of the apparatus.

Advantageously, an apparatus according to preferred embodiments of the invention comprises a single reversible electric motor which is carried by said hollow body (this single electric motor therefore being a pumping motor which acts as drive motors by means of hydraulic reaction), this motor comprising a drive shaft mechanically connected to each pumping propeller.

The different periods of time for controlling the apparatus in the different trajectories can be predetermined or defined in a random manner and can be optimized, for example in accordance with the application.

Advantageously and according to the invention, said electric control unit is configured to control each motor principally in a forward direction, and to control each motor from time to time in a backward direction in the first speed and from time to time in a backward direction in the second speed.

Advantageously and according to the invention, said electric control unit is adapted to control at least one predetermined period of operating time for each drive motor in one direction and at one speed.

Advantageously and according to the invention, said electric control unit is adapted to control in a random manner at least one period of operating time for each drive motor in one direction and at one speed.

The invention also relates to an apparatus characterized in combination by all or some of the features mentioned above or below.

Figure 2:
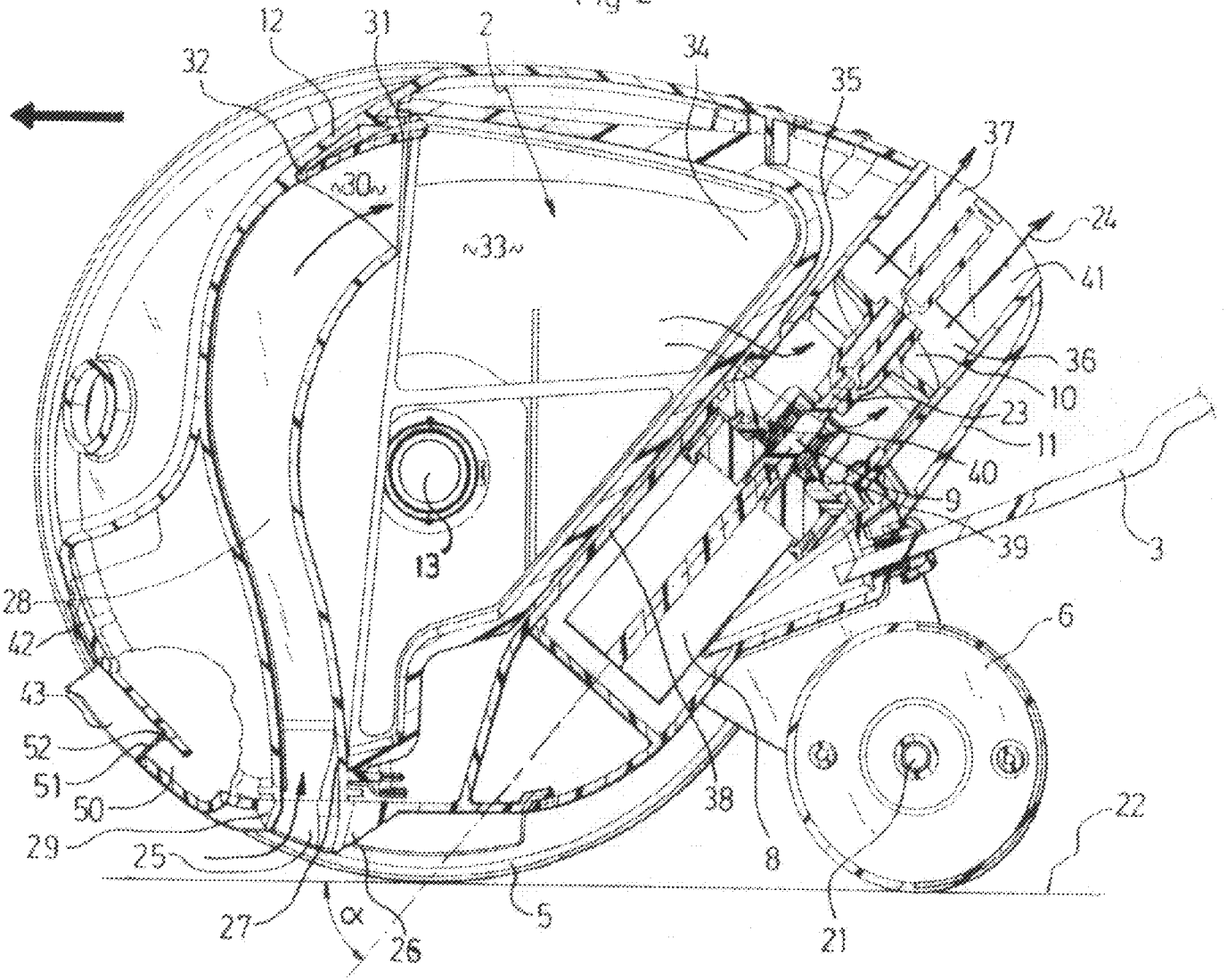
Figure 3:
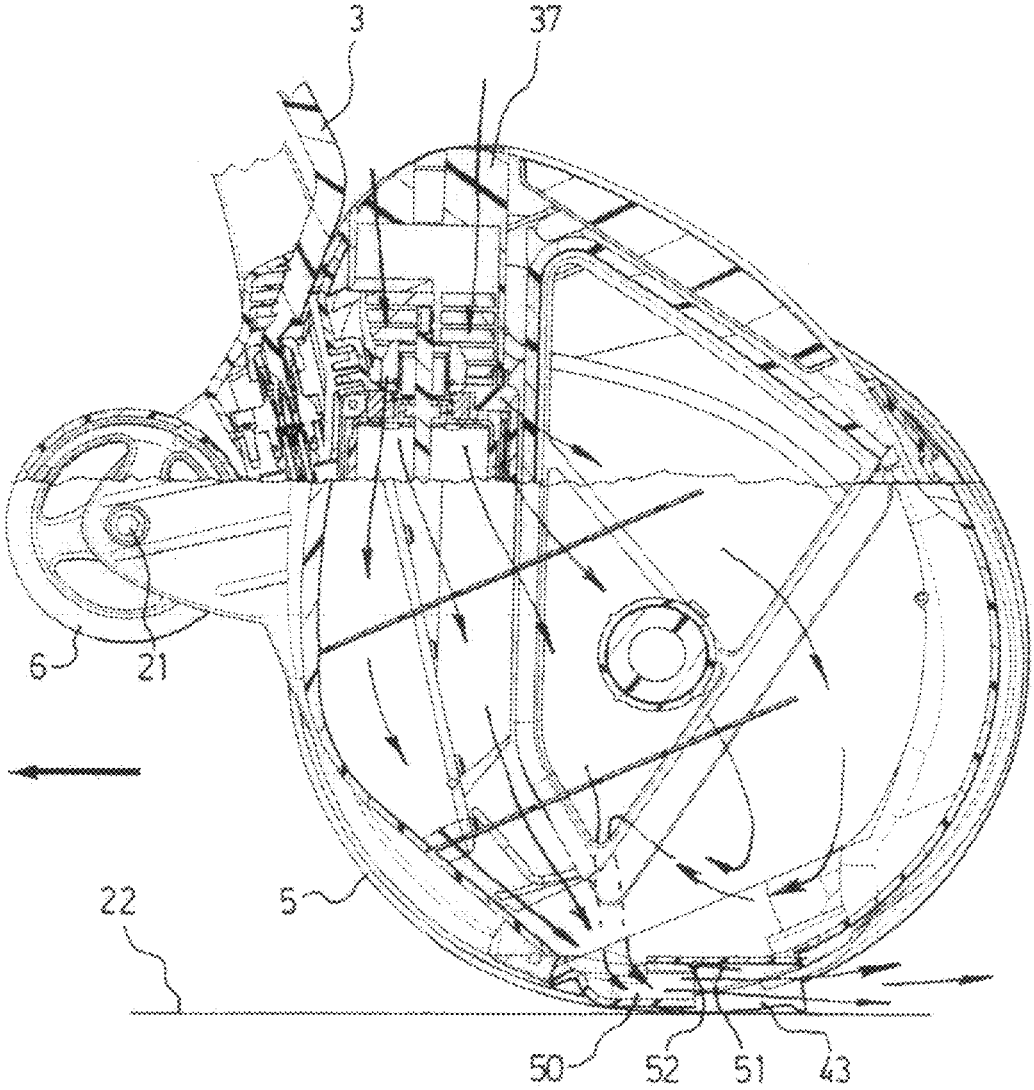
Figure 4:
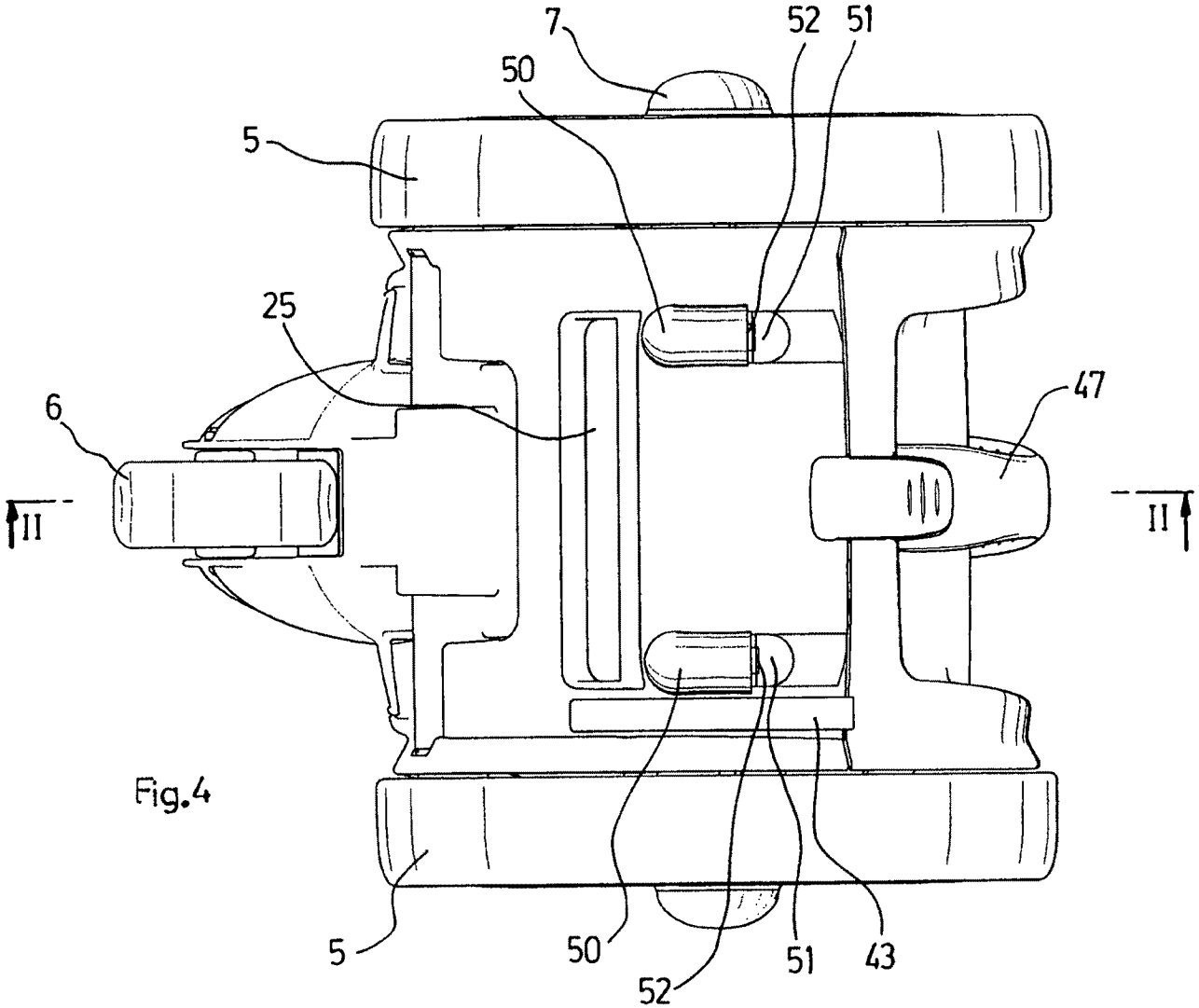

Other objects, features and advantages of the invention will be appreciated from a reading of the following description, which is given by way of non-limiting example and with reference to the appended Figures, in which:

FIG. 1 is a schematic perspective view of an apparatus according to one embodiment of the invention, FIG. 2 is a schematic section along line II-II of FIG. 4, the apparatus being illustrated in a forward movement direction in the normal cleaning movement position, FIG. 3 is a schematic section along line of FIG. 1, the apparatus being illustrated in a backward movement direction in a nosed-up movement position, FIG. 4 is a schematic bottom view of the apparatus of FIG. 3.

The apparatus according to the invention illustrated in the Figures is a self-propelling apparatus of the electrical type for cleaning an immersed surface, that is to say, connected only by an electric cable 3 to a control unit located out of the liquid. All along the text, unless indicated otherwise, the apparatus is described with a movement position on an immersed surface (inclination in a plane containing the movement direction and orthogonal with respect to the immersed surface) which is assumed to be horizontal. Of course, the apparatus according to the invention can move equally well on non-horizontal surfaces, in particular inclined or vertical surfaces.

This apparatus comprises a hollow body 1 formed by different walls which are composed of rigid synthetic material and which are fitted to each other allowing, on the one hand, a filtration chamber 2 to be delimited and, on the other hand, a chassis to be formed which receives and carries guiding and driving members 5, 6, a single electric motor 8 which has a drive shaft 9, a mechanical transmission between the drive shaft 9 of the electric motor 8 and at least one guiding and driving member, called a motorized member 5, and an axial pumping propeller 10.

In the embodiment illustrated, the hollow body 1 has a rear lower shell 11 which forms a chassis, supplemented by a front upper cover 12 which can be removed from the shell 11. The cover 12 is provided with a front handle 47 allowing the apparatus to be handled and transported.

The shell 11 has two large lateral front wheels 5 which are coaxial and which have the same diameter. The wheels 5 have the largest diameter possible which does not increase the vertical spatial requirement of the apparatus. That is to say, the diameter of the front wheels 5 corresponds at least to the overall height (dimension in the orientation normal with respect to the rolling plane 22 on the immersed surface) of the apparatus according to the invention. For example, the diameter of the front wheels 5 is between 250 mm and 300 mm, in particular in the order of 275 mm.

These large wheels 5 have been found to have significant and unexpected advantages. First of all, they prevent any untimely contact of a protruding portion of the hollow body on the immersed surface and thus allow this immersed surface to be protected to some degree during the operation of the apparatus. In turn, they provide a degree of protection for the hollow body itself with respect to impacts from external objects which only come into contact with the large wheels 5. They are further particularly advantageous in the context of an apparatus which has at least one nosed-up position in at least one drive direction in so far as they considerably facilitate this nosing-up action. They limit the risks of blockage on the irregularities (in particular hollows and/or reliefs) of the small immersed surface and have multiple contact zones with different orientations (top, front, bottom) with the immersed surface. By providing particularly efficient and effective guiding, they allow the performance levels and features of the other required guiding members to be reduced (simple small wheel 6 in the examples illustrated), even allow them to be dispensed with (variant which is not illustrated). They are particularly advantageous in combination with a pumping motor 8 having an inclined axis as described below.

The front wheels 5 form a front axle 7. Each front wheel 5 is guided freely in rotation on the shell 11 about the same transverse rotation axis 13 defining the axis of the front axle 7 which, in the preferred embodiment illustrated, is a non-drive axle.

The shell 11 also carries a small rear wheel 6 which can freely rotate (non-driving wheel) about a transverse rotation axis 21. This small wheel 6 constitutes a guiding member which, in the example illustrated, also does not carry out a driving function. The two front wheels 5 and the small rear wheel 6 define the same plane, called a rolling plane 22, which corresponds to the immersed surface when the apparatus is moving normally over the surface with a cleaning action, all the wheels 5, 6 being in contact with the immersed surface.

The single electric motor 8 acts as a pumping motor which drives the propeller 10 in rotation about the axis thereof. To this end, the drive shaft 9 of the motor 8 opens axially so as to protrude from the body of the motor with a rear upper end 23, to which the pumping propeller 10 is directly coupled so as to be fixedly joined in rotation.

The shell 11 carries the electric motor 8 in an inclined position relative to the rolling plane 22, that is to say, with the drive shaft 9 inclined through an angle $\alpha$ which is not 0° or 90° relative to the rolling plane 22. In particular, the drive shaft 9 is not orthogonal relative to the rolling plane 22. The angle $\alpha$ of inclination is between 30° and 75°, for example in the order of 50°. The angle α is also the inclination angle of the axis of the propeller 10 and the orientation 24 of the hydraulic flux generated thereby. The angle α also corresponds to the general orientation of the hydraulic reaction generated by the flux of liquid at the outlet 37 in a normal pumping direction and towards the filter 33 in a backward direction.

Such an inclination has a number of advantages, and in particular allows a great compactness to be conferred on the apparatus according to the invention and allows the force of the hydraulic reaction resulting from the liquid flow generated by the propeller 10, in particular its component parallel with the rolling plane 22, to be used for driving the apparatus in a normal forward cleaning direction.

The shell 11 also has a lower opening 25 which extends transversely substantially over the entire width and which is slightly offset towards the front relative to the vertical transverse plane (orthogonal with respect to the rolling plane 22) which contains the axis 13 of the drive axle 7. This opening 25 forms a liquid inlet at the base of the hollow body in a normal pumping direction for cleaning the immersed surface.

This opening 25 preferably has a flap 26 which extends along the rear edge thereof and at the sides in order to facilitate the suction of the debris. The opening 25 preferably also has a rib 29 which extends along its front edge, protruding downwards, in order to create a turbulence effect at the rear of this rib 29 which tends to disengage the debris from the immersed surface and accelerate the flux of the liquid entering the opening 25.

The opening 25 is adapted to receive a lower end 27 of an inlet conduit 28 which is integral with the cover 12. The assembly constitutes a liquid inlet at the base of the hollow body 1, via which the liquid is drawn in by the suction resulting from the pumping propeller 10 when it is driven in a normal pumping direction by the motor 8.

The conduit 28 generally extends over the entire width of the cover 12 and upwards (substantially orthogonally with respect to the rolling plane 22) as far as an upper opening 30 which is provided with a pivoting shutter 31 which acts as a valve. The shutter 31 is articulated about a horizontal transverse axis 32 located at the front of the opening 30. The cover 12 is configured to be able to receive and carry a filter 33 which extends at the rear of the conduit 28 so as to receive the liquid flow (loaded with debris) from the upper opening 30 of the inlet conduit 28. This filter 33 is formed by rigid filtering walls and is in liquid communication at the upper rear portion 34 thereof with an inlet 35 of a conduit 36 which receives the axial pumping propeller 10, this conduit 36 generally extending in the pumping orientation 24 of the liquid, in continuation towards the rear towards the top of the drive shaft 9, as far as an outlet, called a main outlet 37, for the liquid out of the hollow body 1 via which the filtered liquid is generally discharged in the orientation 24 when the propeller 10 is driven by the motor 8 in the normal cleaning pumping direction. The path of liquid in the normal cleaning direction in the hydraulic circuit for liquid circulation thus formed between the liquid inlet 25 and the main liquid outlet 37 through the filter 33 is illustrated schematically by arrows in FIG. 2.

The motor 8 is carried below an inclined fluid-tight lower wall 38 of the shell 11 which delimits the filtration chamber 2 receiving the filter 33. The upper end 23 of the drive shaft 9 extends through the fluid-tight wall 38 in a portion 39 thereof which forms the lower portion of the conduit 36 and this passage itself is fluid-tight, that is to say, is produced by a device 40 having sealing joint(s) (for example of the stuffing box type) which provide(s) the sealing between the rotating drive shaft 9 and the wall 38.

The main liquid outlet 37 out of the hollow body 1 is provided with a protective grill 41 which guides the flux generated in a normal pumping direction and prevents the passage of debris in the backflow direction towards the inner side of the hollow body 1 when the propeller 10 is driven in a backward direction counter to the normal cleaning direction.

The control unit is preferably located out of the liquid and is configured to provide, via the cable 3, a supply voltage to the motor 8. This supply voltage, depending on its polarity, allows the motor 8 to be controlled in one direction or the other and in accordance with different rotation speeds. Such a control unit can be formed by an electrical power supply which is branched with respect to the mains supply and which comprises a pulse width modulation control logic unit which controls a circuit which forms a voltage source (based on at least one transistor in commutation) whose output is chopped at high frequency with a pulse width which is variable in accordance with the signal supplied by the control logic unit. The control unit comprises an inversion circuit which allows a supply voltage to be provided for the motor 8 whose polarity can be changed (positive polarity for driving in a forward direction; negative polarity for driving in a backward direction) and whose mean value can be modified owing to the pulse width modulation logic unit in order to take a value from a plurality of different values corresponding to several drive speeds of the motor 8, respectively, and therefore to several movement speeds of the apparatus. The sign + indicates a movement in a forward direction; the sign – indicates a movement in a backward direction. In the example, if it is desirable for the apparatus to be able to move at a normal predetermined speed +V in a forward direction, at a first speed –V1 in a backward direction or at a second speed –V2 in a backward direction, the control logic unit can be programmed so that the control unit provides a voltage whose mean value can take, at an absolute value, a value selected from three predetermined values corresponding to these three speeds.

The control unit may advantageously incorporate a time delay logic unit which allows the various drive directions and the various speeds to be controlled in accordance with periods of time which are predetermined, fixed and stored and/or defined randomly, for example by a pseudo-random variable generator. Such a control unit is particularly simple in terms of its design and production.

In a first rotation direction of the motor 8 and the shaft 9 thereof, the apparatus is driven in the forward movement direction, the small wheel 6 being at the rear of the drive axle in contact with the immersed surface. In this first rotation direction, the axial pumping propeller 10 is driven in the normal cleaning direction of the liquid from the opening 25 at the base of the hollow body 1 as far as the main outlet 37 via which the liquid is discharged. The shutter 31 is open and the pieces of debris drawn in via the opening 25 with the liquid are retained in the filter 33.

In this first rotation direction, the motor 8 is controlled at a predetermined speed so that the apparatus is driven, by the horizontal component of the hydraulic reaction, in a forward movement direction at a predetermined speed +V, called a normal speed, which is as rapid as possible in order to optimize the pumping and cleaning. Preferably, the normal speed +V corresponds to the maximum rotation speed of the motor 8. When the apparatus is thus driven forwards, its trajectory is normally in a straight line orthogonal with respect to the axis 13 of the axle 7, the two front wheels 5 being parallel with each other and orthogonal with respect to the axis 13, and the small wheel 6 being in contact with the immersed surface.

In the other rotation direction of the motor 8, the apparatus is driven in a backward movement direction by the horizontal component of a hydraulic reaction force as described below, the small wheel 6 being in front of the axle 7 relative to this movement direction. In this second rotation direction, the axial pumping propeller 10 is driven in the opposite direction to its normal pumping direction and generates a non-zero flow of liquid in a backward direction, called a nosing-up flow, from the main outlet 37 to the inner side of the hollow body 1, this nosing-up flow being discharged from the hollow body via at least one secondary outlet 50 which opens at the front of the shell, and which is orientated towards the front so that the current of liquid, called a nosing-up current, which is discharged via this secondary outlet 50 generates a hydraulic reaction which has a nosing-up component of the hollow body 1 about the axis 13 of the axle 7. In the example illustrated, two secondary outlets 50 are provided, which are generally orientated towards the front and orthogonally with respect to the axis 13 of the axle 7, so as to be symmetrical with each other with respect to a median direction of the axle 7.

The propeller 10 is an axial pumping propeller which has unidirectional pitch and which is preferably fixed (having blades which are rigidly fixed to a rotor and which extend radially relative thereto having a pitch in only one direction) and which generates a flow of liquid which is generally orientated in accordance with the rotation axis thereof (the propeller 10 therefore not being of the centrifugal type) in one direction or the other in the direction of rotation of the propeller about the axis thereof. The propeller 10 is optimized to generate an optimum flow when it is rotatably driven about its axis in the normal pumping direction. However, when it is rotatably driven about the axis thereof in the opposite direction to the normal pumping direction, the propeller 10 generates a non-zero flow of liquid in a backward direction.

In this regard, it should be noted that the pumping propeller 10 is a propeller with unidirectional pitch which is directly coupled so as to be fixedly joined in rotation to the rear upper end 23 of the drive shaft 9. An axial pumping propeller with unidirectional pitch comprises blades which generally extend radially and have a pitch which is preferably fixed but which could be variable but, in any case, does not change direction, that is to say, is always orientated in a single direction, so that the direction of the liquid flux generated by the rotation of the propeller is dependent on the rotation direction thereof. When the propeller 10 is rotatably driven in the normal pumping direction (corresponding to the cleaning of the immersed surface), it pumps the liquid from the liquid inlet 25 at the base of the hollow body as far as the main liquid outlet 37. When the propeller 10 is rotatably driven in a backward direction, it pumps the liquid in the direction of the backflow from the main liquid outlet 37 as far as the secondary outlets 50.

The axial pumping propeller 10 which is driven in a backward direction generates a flow of liquid which is able to be discharged from the hollow body 1 via each secondary outlet 50. In the example illustrated, two secondary liquid outlets 50 are provided, one at each side of the vertical longitudinal center plane of the apparatus. Each secondary outlet 50 is provided with a shutter 51 which is mounted so as to pivot freely about a transverse axis 52 and which is returned into a closed position, when the motor 8 is driven in a normal rotation direction, by the effect of gravity and/or by the suction generated by the flow of liquid being discharged via the main outlet 37.

The liquid current which is discharged via at least one such secondary outlet 50 is orientated so that this current creates by means of reaction, forces whose resultant, called a secondary hydraulic reaction force, generates a nosing-up torque and produces nosing-up of the apparatus by pivoting the hollow body about the axle 7. This nosing-up torque about the axis 13 of the drive axle 7 allows the apparatus to be nosed-up, that is to say, allows the small wheel 6 to be raised when the apparatus is moving on the same wall of the immersed surface. In this manner, such a secondary hydraulic reaction force applies a pivot torque of the apparatus about the axis 13 of the drive axle 7 in the direction in which the nosing-up action of the apparatus is increased. To this end, it is necessary and sufficient for the orientation of the liquid flux generated in a backward direction and being discharged via such a secondary outlet 50 not to intersect with the axis 13 of the drive axle 7, and to be orientated in the correct direction.

And, against all expectations in this matter, not only is this backward flow in reality not disadvantageous for the general operation of the apparatus, but instead it is particularly advantageous and in particular allows:

- via the secondary outlets 50, a hydraulic reaction to be applied which, at least from a specific rotation speed, can produce a nosing-up action of the apparatus which brings about modifications of the trajectory of the apparatus during its movements in a backward direction, in terms of gyration at one side or the other,
- the walls of the filter 33 to be periodically unclogged, which serves to increase the service-life of the apparatus and to optimize the operational volume of the filter 33.

In this second rotation direction of the motor 8, the shutter 31 at the upper portion of the inlet conduit 28 is automatically in a closed position (owing to gravity and/or under the action of the flux in a backward direction), preventing any backflow of debris into the conduit 28 so that the pieces of debris remain confined inside the filter 33. The flux in a backward direction is discharged via the secondary outlets 50 whose valves 51 are opened by means of pivoting about the axes 52 thereof under the action of the hydraulic pressure of the liquid in a backward direction.

It should further be noted that the flux of liquid discharged from the secondary outlets 50 in a backward direction and in the nosed-up position of the apparatus generates a secondary hydraulic reaction force which also has at least one component parallel with the rolling plane 22 which is capable of producing the movement of the apparatus in a backward movement direction.

The trajectory modifications of the apparatus during its movements in a backward direction (compared with its trajectory in a forward direction which is, in the example, in a straight line) can be obtained in all appropriate manners, in particular from the modification of the position of the hollow body 1 by nosing-up relative to the axle 7 about the axis 13 (in a plane which is orthogonal with respect to the immersed surface and which contains the movement direction), from a particular rotation speed of the motor 8 in a backward direction.

Preferably, the apparatus is configured so as to be able to be driven in terms of gyration at one side (for example to the left relative to its movement direction) for a first speed of the motor 8 corresponding to a first speed −V1 of movement of the apparatus in a backward direction and to a first position, non-nosed-up for example, of the apparatus, and in terms of gyration at the other side (for example to the right relative to its movement direction) for a second speed of the motor 8 corresponding to a second speed −V2 of movement of the apparatus in a backward direction and to a second nosed-up position of the apparatus. In the Figures, for the backward movement direction of the apparatus, only the nosed-up position of the apparatus corresponding to the second speed of the motor 8 is illustrated. If the position of the apparatus is not nosed-up for the first speed in a backward direction, the general operation of the apparatus is similar to that illustrated in FIG. 2 for the forward movement direction, with the exception of the shutters 31 and 51 and the circulation of the liquid which is reversed.

In this way, there is obtained in an extremely simple manner an apparatus which, in a forward direction, moves in a straight line and, in a backward direction, depending on the rotation speed of the motor 8, moves by turning to the left or by turning to the right. Consequently, all the useful trajectories of a cleaning apparatus are obtained, which greatly facilitates the cleaning coverage and the rapidity of cleaning the immersed surface.

The general balance of the apparatus can be adapted in order to obtain each desired nosed-up or non-nosed-up position, in accordance with the various corresponding speeds.

Trajectory modifications can be obtained in accordance with the position of the apparatus, which is nosed-up to a greater or lesser extent or non-nosed up, that is to say, in accordance with the inclination of the hollow body 1 about the axis 13 of the drive axle 7 relative to the immersed surface, for example (non-illustrated variant) owing to the fact that the horizontal component (parallel with the immersed surface) of the hydraulic advance resistance in a backward direction is unbalanced and produces a gyration at one side of the apparatus. To this end, the shell 11 may have shutters or ribs whose hydraulic effect is dependent on the nosed-up inclination of the apparatus.

According to another variant which is not illustrated, these trajectory modifications can be obtained by laterally offsetting a guiding and/or brushing member, or in accordance with a spontaneous pivoting of a small wheel following the change in movement direction.

In a variant or in combination (not illustrated), trajectory modifications can be obtained by a given lateral inclination at each secondary outlet 50 relative to the longitudinal direction orthogonal with respect to the axle 7 and/or by means of different configurations of the guiding members 5, 6 in contact with the immersed surface and/or by means of laterally offset braking members which may or may not come into contact with the immersed surface in accordance with the nosed-up position of the apparatus.

In the preferred variant illustrated, the shell 11 has a wall portion 42 which extends forwards from the opening 25, over the entire width thereof, substantially conforming to the contour of the front wheels 5. This wall portion 42 is provided with a runner 43 which is arranged so as to be able to come into contact with the immersed surface in order to locally brake and/or disengage the hollow body 1 if the apparatus takes up a predetermined nosed-up position, the small wheel 6 being disengaged from said immersed surface.

This fixed runner 43 is arranged at one side, for example, at the right-hand side as illustrated, so as to be integral with the front portion 42 of the shell 11 and extends so as to protrude radially outwards from this portion 42 in order to come into contact with the immersed surface when the apparatus is in a nosed-up position for a speed −V2 of movement in a backward direction corresponding to the second rapid rotation speed of the motor 8. In this nosed-up position, the apparatus is driven in terms of gyration at one side (to the left relative to the movement direction in the example illustrated) in a backward direction owing to the friction of the runner 43 on the immersed surface and/or disengagement of the front right wheel 5. The runner 43 is arranged at the front of the axle 7 and, in the nosed-up position, comes into contact with the immersed surface at the rear of the drive axle relative to the movement direction (backward direction).

The runner 43 is arranged so as to come into contact with the immersed surface only in said nosed-up position. In particular, in the normal non-nosed-up position, the runner 43 is not in contact with the immersed surface, is remote therefrom, and is therefore inactive, all the wheels 5, 6 being in contact with the immersed surface.

The control unit is extremely simple in terms of its design and production. It is configured so that the apparatus is principally driven forwards in a straight line. The motor 8 is interrupted from time to time and controlled in a backward direction at the first slow speed (corresponding to the movement speed −V1) from time to time and at the second rapid speed (corresponding to the movement speed −V2) from time to time. The different time periods for control of the motor 8: T1 in a forward direction at rapid speed +V, T2 in a backward direction at slow speed −V1, T3 in a backward direction at normal rapid speed −V2, and T4 the interruptions of the motor 8, are defined in a random manner (by a random generator, that is to say, a pseudo-random variable generator) and/or in a predetermined manner. Preferably, these time periods can be defined so as to limit the entanglement of the cable 3, that is to say, ensuring that the totals of the periods of time of gyration to the left are similar to the totals of the periods of time of gyration to the right.

For example, T1 is between 10 sec. and 1 min., for example in the order of 20 sec.; T2 and T3 are both less than T1, for example between 3 sec. and 15 sec., in particular between 5 sec. and 8 sec.; and T4 is less than each of the periods of time T1, T2 and T3 and is between 0.5 sec. and 5 sec., in particular it is in the order of 2 sec. The value V corresponds to the maximum speed of the motor 8 (no pulse width modulation of the voltage supplied by the control unit), V1 corresponds to 50% of the maximum speed of the motor (V1=0.5V) and V2 corresponds to 80% of the maximum speed of the motor (V2=0.8V). Of course, other values are possible.

It should be noted that the control of each nosed-up position of the apparatus does not require a particularly complex operational logic unit in so far as it can be obtained by means of simple balance of the apparatus during production. Furthermore, the presence of the runner 43 facilitates this control, the runner 43 acting as a stop which limits the pivoting in the nosed-up position. Furthermore, this control can remain relatively imprecise in so far as the periods of time for placing the apparatus in a nosed-up position are short, this movement configuration not corresponding to the normal cleaning configuration.

The apparatus according to the invention is extremely simple in terms of design and construction and therefore very economical but nevertheless very effective. With a single electric motor 8 and a control unit which is reduced to its most simple form, all the most complex functionalities of an electric apparatus are obtained. The apparatus according to the invention is further particularly light, easy to handle, ergonomic and particularly aesthetic. It consumes very little energy and is environmentally friendly. It has a great service-life and excellent inherent reliability, particularly due to the small number of components it contains.

The invention may include numerous variants from the preferred embodiment illustrated in the Figures and described above. In particular, the invention can equally well be used in an apparatus which is provided with motorized or non-motorized guiding and driving members other than wheels (chains, brushes, etc.). Also, the apparatus may have several liquid inlets, several main liquid outlets, even several pumping propellers which are driven by the same motor. However, one advantage of an apparatus according to the invention is that it is able to have only one liquid inlet 25, only one main liquid outlet 37, only one hydraulic circuit and only one axial pumping propeller 10 which is coupled directly to the drive shaft 9 of the electric motor 8. The motor 8 can be driven in accordance with a discrete plurality of speeds which may comprise only a single speed in a forward direction or in a backward direction, or a first rapid speed in a forward direction and a slower speed in a backward direction, or more different speeds than in the example described above. The secondary hydraulic reaction force may be adapted in order to generate, in accordance with the rotation speed of the motor, different nosed-up positions which are obtained by means of simple general balance of the hollow body and/or by means of one or more runners(s) (such as the runner 43) for locking in each nosed-up position. The runner 43 may be replaced or supplemented by another runner which is laterally offset at the opposing side and/or by another runner which is generally centered in a median direction of the axle (not laterally offset) producing about, in a predetermined nosed-up position of the apparatus, a disengagement of the two wheels 5 and a random gyration of the apparatus owing to the inevitable imbalances thereof (for example owing to the necessarily eccentric traction of the electrical power supply cable). The runner(s) may be replaced completely or partially by (a) small wheel(s) which rotate(s) freely or which is/are at least partially braked when it/they is/are in contact with the immersed surface.

The apparatus according to the invention advantageously has no actuator or on-board logic circuit and/or electronic circuit. In a variant, there is nothing to prevent the apparatus from being able to comprise, if necessary, on-board electronic components and/or actuators. For example, the control unit could be on-board, including for example with a series of on-board accumulators which act as a source of electrical energy, the apparatus being completely independent. Furthermore, though the embodiment of the apparatus according to the invention mentioned above is illustrated in the Figures in which it is driven in a completely hydraulic manner is particularly advantageous and preferred, there is nothing to also prevent the motor 8 from being able to be used at least partially for driving one or more drive wheels and/or one or more other specific motor(s) for driving one or more drive wheel(s) or other driving members.

The invention claimed is:

1. An apparatus for cleaning a surface immersed in liquid, comprising:

a. a body defining (i) an inlet, (ii) a main outlet, (iii) a secondary outlet, and (iv) a filtration chamber containing a filtering device;

b. means, comprising an axle and a first rolling member connected to the axle, for guiding the body over the immersed surface; and c. means for pumping liquid alternately (i) in a first flow path from the inlet through the filtering device to the main outlet or (ii) in a second flow path from the main outlet to the secondary outlet, with liquid pumped in the second flow path generating a pivot torque of the body about the axle.

2. An apparatus according to claim 1 in which the liquid-pumping means comprises a propeller.

3. An apparatus according to claim 2 in which the propeller has unidirectional pitch.

4. An apparatus according to claim 3 in which the liquid-pumping means further comprises an electric motor comprising a drive shaft mechanically connected to the propeller.

5. An apparatus according to claim 4 in which the electric motor is reversible and configured to rotate the propeller in each of (a) a first direction so as to pump liquid in the first flow path and (b) a second direction, opposite the first direction, so as to pump liquid in the second flow path.

6. An apparatus according to claim 5 further comprising an electric control unit communicating with the electric motor.

7. An apparatus according to claim 1 in which pivoting of the body about the axle places the body in a nosed-up position, further comprising a runner configured to contact the immersed surface when the body is in the nosed-up position.

8. An apparatus according to claim 7 in which the runner is offset laterally relative to the axle.

9. An apparatus according to claim 1 in which the first rolling member is a first wheel and the axle is a non-drive axle.

10. An apparatus according to claim 9 further comprising a second rolling member in the form of a second wheel connected to the axle.

11. An apparatus according to claim 10 further comprising a third wheel disconnected from the axle.

12. An apparatus according to claim 11 in which pivoting of the body about the axle places the body in a first nosed-up position in which the third wheel does not contact the immersed surface.

13. An apparatus according to claim 1 further comprising a moveable first shutter configured to close the secondary outlet when liquid is pumped in the first flow path.

14. An apparatus according to claim 13 further comprising means, comprising a moveable second shutter, for preventing debris from exiting the filtering device when liquid is pumped in the second flow path.

15. An apparatus according to claim 1 in which liquid pumped in the first flow path causes the rolling member to roll so as to move the body in a nominally forward direction along the immersed surface.

16. An apparatus according to claim 15 in which liquid pumped in the second flow path also causes the rolling member to roll so as to move the body in a nominally backward direction along the immersed surface.

17. An apparatus according to claim 6 in which the drive shaft is configured to rotate at first and second speeds under control of the electric control unit.

18. An apparatus according to claim 17 in which the first speed is slower than the second speed and, (a) when the drive shaft rotates at the first speed and the propeller rotates in the second direction, liquid pumped in the second flow path causes the rolling member to roll so as to move the body in a nominally backward direction along the immersed surface, and (b) when the drive shaft rotates at the second speed and the propeller rotates in the second direction, liquid pumped in the second flow path generates pivot torque sufficient to cause the body to pivot about the axle into a nosed-up position.

* * * * *